US006955312B2

(12) United States Patent
Beaulieu et al.

(10) Patent No.: US 6,955,312 B2
(45) Date of Patent: Oct. 18, 2005

(54) APPARATUS AND METHOD FOR COMMINUTING ROCK

(75) Inventors: Langis Beaulieu, Cacouna (CA); Rolande Plourde, Cacouna (CA)

(73) Assignee: Equipments Lan-Ro Inc., Cacouna (CA)

( * ) Notice: Subject to any disclaimer, the term of this patent is extended or adjusted under 35 U.S.C. 154(b) by 55 days.

(21) Appl. No.: 10/323,824

(22) Filed: Dec. 20, 2002

(65) Prior Publication Data

US 2004/0118955 A1 Jun. 24, 2004

(51) Int. Cl.[7] ..... B02C 13/286; B02C 17/02

(52) U.S. Cl. ..... 241/101.763; 241/86.1; 241/88.4

(58) Field of Search ..... 241/86.1, 88.4, 241/89.1, 89.3, 101.763

(56) References Cited

U.S. PATENT DOCUMENTS

| | | | | | |
|---|---|---|---|---|---|
| 1,648,625 | A | * | 11/1927 | Shelton | 241/82 |
| 2,368,331 | A | * | 1/1945 | Seaman | 404/92 |
| 3,146,959 | A | * | 9/1964 | Putnam, Jr. | 241/86.1 |
| 3,627,212 | A | * | 12/1971 | Stanton | 241/73 |
| 3,701,485 | A | | 10/1972 | Kimble et al. | |
| 3,915,395 | A | * | 10/1975 | Graf | 241/101.71 |
| 3,952,811 | A | | 4/1976 | Carre | |
| 4,005,755 | A | * | 2/1977 | Bakke et al. | 172/32 |
| 4,046,325 | A | * | 9/1977 | Tucsok et al. | 241/73 |
| 4,373,678 | A | | 2/1983 | Reitter | |
| 4,417,627 | A | | 11/1983 | Willibald | |
| 4,607,799 | A | | 8/1986 | Currie | |
| 4,714,207 | A | | 12/1987 | Schrödl | |
| 4,836,457 | A | * | 6/1989 | Greiner | 241/73 |
| 5,695,255 | A | | 12/1997 | LeBlond | |
| 6,102,312 | A | | 8/2000 | Aberle | |
| 6,371,001 | B1 | | 4/2002 | Schmid | |

FOREIGN PATENT DOCUMENTS

| | | |
|---|---|---|
| CA | 2075830 | 2/1994 |
| CA | 2130292 | 2/1995 |
| CA | 2137758 | 6/1995 |
| CA | 2121546 | 11/1999 |
| CA | 2147012 | 2/2001 |
| EP | 0 160 606 | 11/1985 |

* cited by examiner

*Primary Examiner*—Daniel C. Crane
(74) *Attorney, Agent, or Firm*—Ogilvy Renault LLP

(57) ABSTRACT

An apparatus for comminuting rocks, comprising a frame having a restrictive passageway with an inlet and an outlet end for relative displacement of rocks from the inlet to the outlet end. A rotary impacting device is secured to the frame in the passageway so as to be journaled with respect to the frame. The rotary impacting device has hammer elements on an outer periphery of the device. The hammer elements are adapted to scoop and impact rocks in the passageway to project the rocks toward the outlet of the apparatus. An actuator is mounted to the frame and operationally connected to the rotary impacting device for imparting a rotation of the rotary impacting device. A screen is adapted to comminute upon impact the rocks propelled thereon by the rotary impacting device. The screen is positioned at the outlet end such that comminuted rocks exiting from the apparatus are below a predetermined size.

17 Claims, 2 Drawing Sheets

APPARATUS AND METHOD FOR COMMINUTING ROCK

TECHNICAL FIELD

The present invention generally relates to equipment for comminuting or crushing rocks into finer particles.

BACKGROUND ART

There exists a plurality of rock-crushing apparatuses and methods for comminuting rocks into finer particles, such as gravel. Gravel is typically used for landscaping, and many other construction applications, etc. There are numerous uses for crushed stone. For instance, rock-crushing apparatuses are typically used to transform an uneven terrain into a practical road or path. More recently, the recreational industry has created a need for bicycle paths of gravel.

U.S. Pat. No. 3,701,485, issued on Oct. 31, 1972 to Kimble, discloses a "Rotor Construction for Impact Crusher." U.S. Pat. No. 4,373,678, issued to Reitter on Feb. 15, 1983, is entitled "Rotary Impact Crusher Having a Continuous Rotary Circumference." Both these patents describe impact crushers that include a rotary element that entrains rocks into a throat portion wherein rocks are crushed into finer particles. The crushing is caused by a combination of the action of the rotary element on the rocks caught in the throat portion, and impact between the rocks.

In designing rock-crushing apparatuses, a few factors are of importance. The performance of a rock crusher, i.e., the quantity of rock crushed with respect to time (e.g., tons/hour), is a primary feature in the rating of a rock-crushing apparatus. In the existing rock-crushing apparatuses, the rotary element is directly involved in the crushing of rocks by exerting a squeezing pressure on the rocks in the throat portion of the machine, whereby the rotary speed is directly related to the rate of production of the rock-crushing apparatuses.

It is also important that the rock-crushing apparatuses give consistent results. For instance, rock-crushing apparatuses are typically rated in accordance with the anticipated dimensions of the rock crushed by the apparatus. For instance, a rock-crushing apparatus can be rated as a zero- to two-inch crusher, in which case rock sizes go from minute particles to two inches at the exit of the apparatus. It is pointed out that the finer the range, the slower the speed of operation.

Another important factor is the durability of the rock-crushing apparatuses. Rock-crushing apparatuses undergo substantial wear of operating pieces. It is possible to increase the productivity of a rock-crushing apparatus if it is durable. Moreover, low maintenance and few repairs help in decreasing the costs related to operation of rock-crushing apparatuses.

These factors have a negative effect on each other. For instance, an increase in speed of the rotary element will most likely have an effect on the durability of the equipment. Moreover, the increased speed can damage the rotary element such that output of the rock-crushing apparatus becomes inconsistent. It would thus be desirable to have a rock-crushing apparatus that optimizes these factors.

SUMMARY OF INVENTION

It is a feature of the present invention to provide a novel apparatus for comminuting rocks.

It is a further feature of the present invention to provide a novel method for comminuting rocks.

It is a still further feature of the present invention to optimize a performance of rock-crushing apparatuses.

According to the above features, and from a broad aspect, the present invention provides an apparatus for comminuting rocks, comprising a frame having a restrictive passageway with an inlet and an outlet end for relative displacement of rocks from the inlet to the outlet end; a rotary impacting device secured to the frame in the passageway so as to be journaled with respect to the frame, the rotary impacting device having at least one hammer element on an outer periphery of the device, the at least one hammer element adapted to scoop and impact rocks in the passageway to project the rocks toward the outlet of the apparatus; actuation means mounted to the frame and operationally connected to the rotary impacting device for imparting a rotation of the rotary impacting device; and screening means adapted to comminute upon impact at least some of the rocks propelled thereon by the rotary impacting device, the screening means being positioned in the outlet end such that comminuted rocks exiting from the outlet end are below a predetermined size.

According to a further feature of the present invention, there is provided a method of use of a hammer element of an apparatus for comminuting rocks, comprising the steps of: i) providing a hammer element having a leading impacting surface and a substantially identical trailing impacting surface opposed thereto, and a connector portion for securing the hammer element to a rotor of an apparatus for comminuting rocks, the impacting surfaces protruding from the rotor; ii) mounting the hammer element to the rotor with a direction of rotation of the rotor being generally normal to the leading impacting surface; iii) impacting rocks with the leading impacting surface of the hammer element by actuating the rotor in rotation, thereby sharpening an edge of the trailing impacting surface; iv) reversing the hammer element such that the direction of rotation of the rotor is generally normal to the trailing impacting surface; and v) repeating step iii) such that the trailing impacting surface impacts rocks.

BRIEF DESCRIPTION OF DRAWINGS

A preferred embodiment of the present invention will now be described with reference to the accompanying drawings in which.

DESCRIPTION OF PREFERRED EMBODIMENTS

Figure 1:
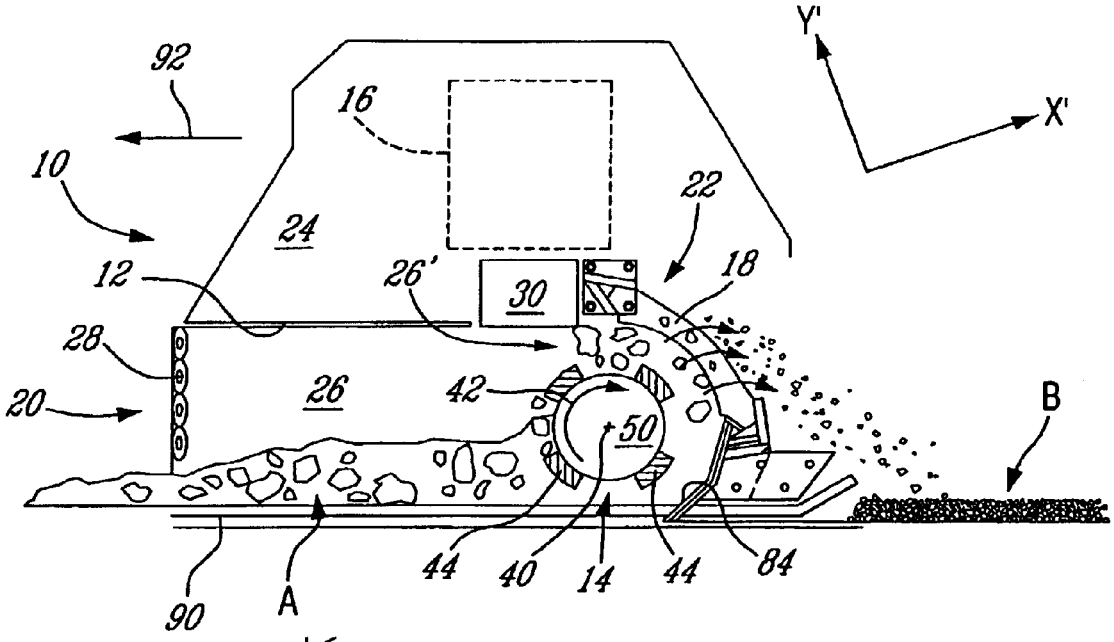
FIG. 1 is a side elevational view, partly cross-sectioned, of an apparatus for crushing rocks constructed in accordance with the present invention.

Referring to the drawings, and more particularly to FIG. 1, an apparatus for comminuting rocks constructed in accordance with the present invention is generally shown at 10, and will hereinafter be referred to as the apparatus 10. The major constituent parts of the apparatus 10 are a frame 12, a rotary impacting device 14, an actuating group 16 and a screen 18.

Still referring to FIG. 1, the frame 12 is shown defining an inlet 20 at a front end thereof, and an outlet 22 at a rear end thereof. The frame 12 includes the casing generally shown at 24, enclosing the actuation group 16 and defining a passageway 26 between the inlet 20 and the outlet 22.

Still referring to FIG. 1, the rotary impacting device 14 is supported by the frame 12 in the passageway 26. The rotary impacting device 14 is driven by a drive train connected to the actuation group 16, and has an axis 40 about which it rotates in the direction illustrated by arrow 42. Accordingly, the rotary impacting device 14 is supported by bearings on opposed ends thereof. More precisely, the rotary impacting device 14 is positioned adjacent to the screen 18 and the outlet 22. The passageway 26 defines a direction going from the inlet 20 to the outlet 22, and the axis 40 is generally perpendicular to this direction.

The rotary impacting device 14 is actuated by the actuation group 16. Actuation from the actuation group 16 is transmitted to the rotary impacting device 14 by the drive train, such as a belt/chain-and-pulley assembly, intermeshing gears or the like. It is pointed out that the bearings and the transmission members must be protected by casing elements of the frame 12 to prevent infiltration by the rocks/dirt particles. This will ensure a longer life of these constituents.

Figure 3:
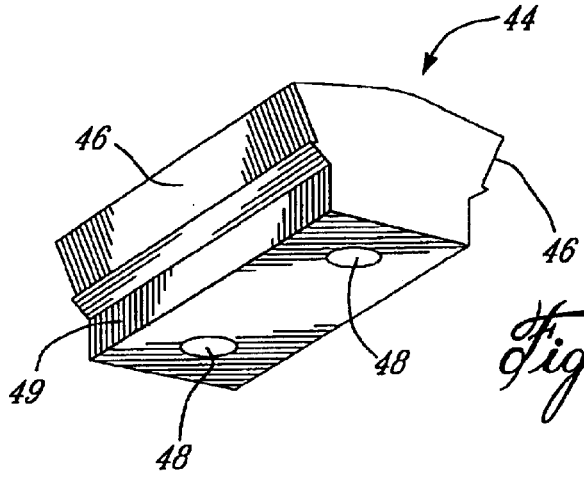
FIG. 3 is a perspective view of a hammer element constructed in accordance with the present invention.
Figure 4:
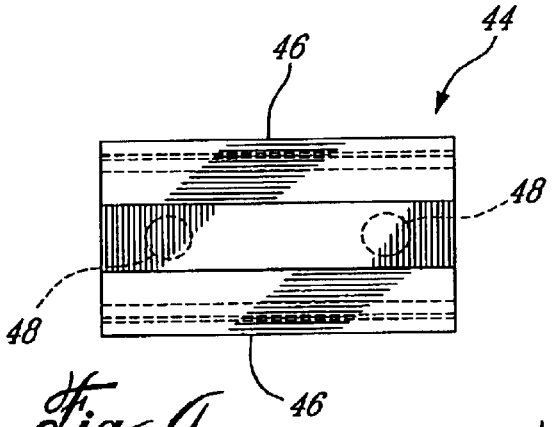
FIG. 4 is a top plan view of the hammer element of FIG. 4.
Figure 5:
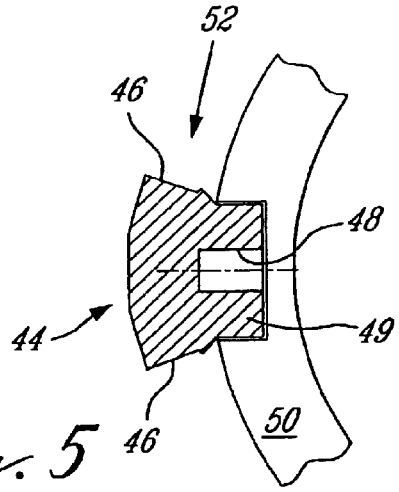
FIG. 5 is a cross-sectional view of the hammer element as secured to a rotor of the present invention.

The rotary impacting device 14 has hammer elements 44 removably secured thereto. Referring to FIGS. 3, 4 and 5, one of the hammer elements 44 is shown in detail. Referring to FIG. 5, the hammer element 44 has a pair of impacting surfaces 46. Connector bores 48 are provided on a connector portion 49 of the hammer element 44 for securing the hammer elements to a rotor portion 50 of the rotary impacting device 14. Preferably, the connector portion 49 is inserted into a corresponding groove of the rotor portion 50, such that only the impacting surfaces 46 protrude radially from the rotor portion 50. When the hammer elements 44 are positioned on the rotor portion 50, axes of the connector bores 48 extend radially from a center of the rotor portion 50, i.e., the axis 40. As shown in FIG. 5, the impacting surfaces 46 create concavities 52 with the rotor portion 50 so as to capture rocks therein. The connector bores 48 are tapped, and receive a connector member, e.g., a bolt, from an interior of the rotor portion 50.

Figure 2:
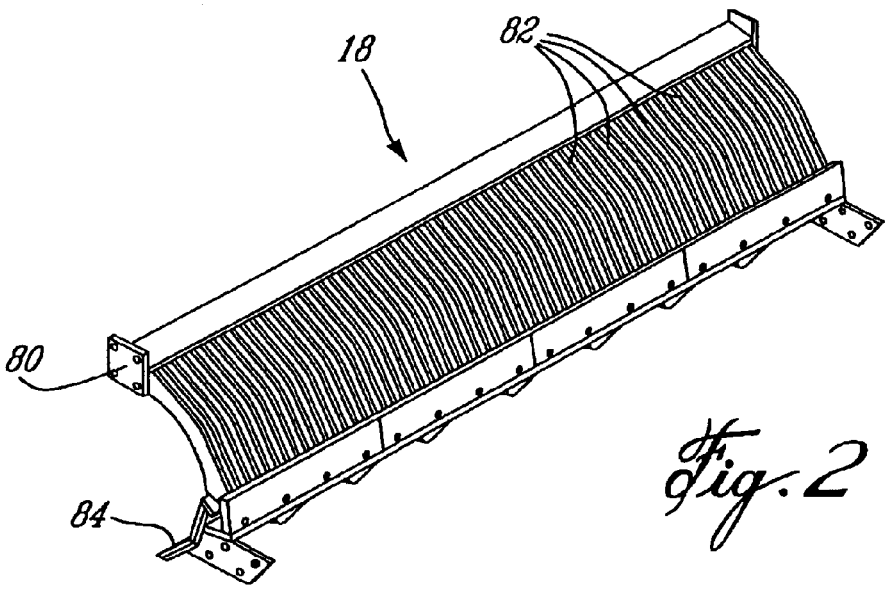
FIG. 2 is a perspective view of a screen of the apparatus for crushing rocks.

Referring to FIG. 2, the screen 18 is shown having a support structure 80 supporting in spaced-apart relation a plurality of ribs 82. The spacing between the ribs 82 is directly related to the output-size specification of the rocks. The screen 18 is positioned in the passageway 26 so as to completely block the outlet 22. Accordingly, rocks will have to go through the ribs 82 to exit the apparatus 10 through the outlet 22. This ensures that the components exiting from the apparatus 10 will only be below a specified size determined by the spacing between the ribs 82.

The screen 18 is configured so as to be readily removable from the frame 12. For instance, size ratings may change in the course of a day, whereby the apparatus 10 must be adapted to produce consistent output with regard to size. Therefore, a plurality of screens 18 with different size ratings can be provided with the apparatus 10.

Moreover, the ribs 82 must be individually removable from the support structure 80. This is necessary when, for instance, one of the ribs 82 is damaged and must be replaced. It is also possible to remove some of the ribs 82 to change the size rating of the screen 18.

The apparatus 10 is provided in a displaceable configuration or in a stationary configuration. In the displaceable configuration, the frame 12 rests on lateral walls on the ground at 90 (FIG. 1), and these lateral walls define the passageway 26 therebetween. Bottom surfaces of the lateral walls are adapted for sliding on the ground when pushed in the direction illustrated by arrow 92 by a vehicle connected to the rear end of the apparatus 10. It is obvious that a vehicle may be attached to a front end of the apparatus 10 to pull the latter in the direction shown by arrow 92.

Still referring to FIG. 1, relative motion is shown between the apparatus 10 and rocks and dirt illustrated at A. Accordingly, rocks and dirt are fed to the rotary impacting device 14, which is actuated in rotation throughout operation of the apparatus 10. Accumulation is created at the rotary impaction device 14, and same entrains rocks and dirt of the accumulation in the concavities 52 (FIG. 5).

The speed of the rotary impacting device 14 causes the rocks and dirt entrained thereby to be propelled against the ribs 82 of the screen 18. The impact will cause the comminution of the rocks, and the momentum of these comminuted rocks will lead them through the outlet 22 out of the passageway 26. Rocks that are either still too large to pass through the gaps between the ribs 82 or that bounce back into the passageway 26 are guided back to the accumulation by guiding portion 84 at the bottom of the screen 18. The guiding portion 84 thus acts as a guiding portion. Once reaching the accumulation, the rocks will be entrained by the rotary impacting device 14.

The guiding portion 84 will perform an entrainment action against rocks above a predetermined size in the case of the displaceable configuration of the apparatus 10. Namely, a gap is provided between a bottom portion of the guiding portion 84 and the ground G, and the gap is chosen so as to allow rocks below a predetermined size to stay on the ground G. On the other hand, rocks above that predetermined size are entrained by the guiding portion 84. As shown in FIG. 1, the output will be in the form of gravel B.

As shown in FIG. 1, a protection screen 28 is provided at the inlet 20 to prevent rocks from being propelled out of the front end of the apparatus 10 due to the direction of rotation of the rotary impacting device 14. For instance, the protection screen 28 may be a set of chains hanging loosely. The chain links have sufficient inertia to stop the rocks.

A throat portion 26' is defined in the passageway 26 between hammer elements 44 of the rotary impacting device 14 and a crusher block 30. Bigger rocks are fragmented into smaller particles by the crushing action created in the throat portion. The crusher block 30 is changeable, and can be chosen according to a desired throat portion size.

In the stationary configuration of the apparatus 10, also illustrated in FIG. 1, a bottom panel is provided at 90 so as to define four walls of the passageway 26. The apparatus 10 is positioned such that the direction of the passageway 26 is not parallel to the ground. As shown in FIG. 1, a coordinate system X'-Y' is provided for the stationary configuration, with the ground being represented by the X'-axis. Accordingly, The inlet 20 is above the outlet 22, such that rocks and dirt fed into the inlet 20 will be directed to the rotary impacting device 14 by sliding against the bottom panel at 90. The feed and the removal of rocks can be performed by a conveyor system (not shown), or by dumpsters unloading their contents at the inlet 20.

In the case of the displaceable or mobile apparatus 10, a portion of the rocks propelled by the rotary impacting device 14 will hit the ground and therefore abrade the top surface of the ground and, for instance, comminute larger rocks that are buried. The level of abrasion can be adjusted by changing the position of the guiding portion 84. This adjustment will enable control of a depth of abrasion of the ground G. Another way to increase the level of abrasion is by increasing the speed of rotation. Moreover, it is preferred to slow the translation of the apparatus 10.

Figure 6A:
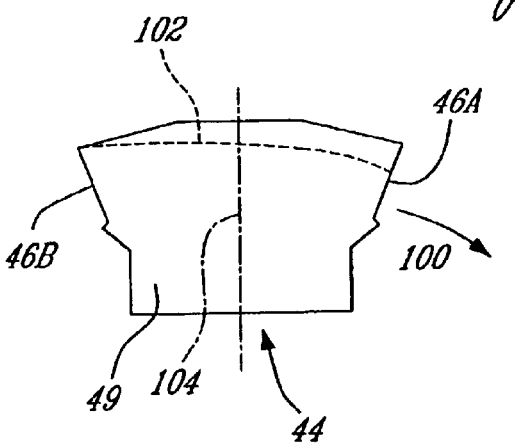
FIG. 6A is a side elevational view of the hammer element subjected to wear.
Figure 6B:
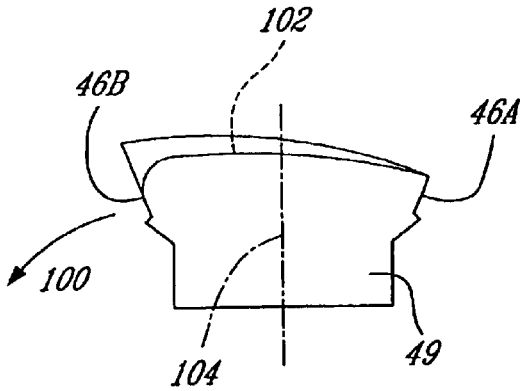
FIG. 6B is a side elevational view of the hammer element of FIG. 6A being further subjected to wear.

Referring to FIGS. 6A and 6B, it is shown how the use of the hammer elements 44 can be optimized. A direction of rotation of the rotary impacting device 14 is shown at 100. The wear of the hammer element 44 is shown by dashed line 102, subsequent to impact with the rocks. Due to the symmetry of the connector portion 49 of the hammer element 44 with respect to a plane normal to axis 104 and to the drawing sheet, the hammer element 44 may be rotated after wear such that one of the impacting surfaces 46, which was previously trailing, now is the leading element. This impacting surface, illustrated at 46B, will show a sharp edge that will enable the entrainment of rocks.

As shown in FIG. 6B, the impacting surface 46B will eventually lose the sharp edge. However, the wear of the rocks will cause the trailing impacting surface 46A to be sharpened, whereby the hammer element 44 can be turned over once more. Therefore, the use of the hammer elements 44 is optimized in the present invention.

It is within the ambit of the present invention to cover any obvious modifications of the embodiments described herein, provided such modifications fall within the scope of the appended claims.

What is claimed is:

1. An apparatus for comminuting rocks, comprising:

a frame having a restrictive passageway with an inlet and an outlet end for relative displacement of rocks from the inlet to the outlet end;

a rotary impacting device secured to the frame in the passageway so as to be journaled with respect to the frame, the rotary impacting device having at least one hammer element on an outer periphery of the device, the at least one hammer element adapted to scoop and impact rocks in the passageway to project the rocks toward the outlet of the apparatus;

actuation means mounted to the frame and operationally connected to the rotary impacting device for imparting a rotation of the rotary impacting device;

screening means adapted to comminute upon impact at least some of the rocks propelled thereon by the rotary impacting device, the screening means being positioned in the outlet end such that comminuted rocks exiting from the outlet end are below a predetermined size; and a throat portion between crusher means secured to the frame and the rotary impacting device upstream of the screening means, for comminution of rocks above a given size.

2. The apparatus according to claim 1, wherein the relative displacement is caused by the frame being displaceable with respect to the ground, the frame being adapted to be connected to a vehicle for displacement with respect to the ground.

3. The apparatus according to claim 1, wherein the relative displacement is caused by the passageway being oblique with respect to the ground with the inlet end being above the outlet such that rocks fed to the inlet end slide toward the outlet end.

4. The apparatus according to claim 1, wherein the crusher means is a removable crusher block secured to the frame generally above the rotary impacting device.

5. The apparatus according to claim 1, wherein the screening means has a guiding portion at bottom thereof such that a portion of rocks not comminuted upon impact are fed to the rotary impacting device.

6. The apparatus according to claim 1, the screening means has a plurality of vertically spaced apart ribs mounted to a support structure.

7. The apparatus according to claim 1, wherein the screening means are removable from the frame, such that screening means are chosen according to desired size ranges of rocks being comminuted by the screening means.

8. The apparatus according to claim 1, further comprising a protection screen at the inlet end to prevent rocks from being propelled out of the passageway by the rotary impacting device.

9. The apparatus according to claim 2, wherein a portion of the rocks are directed downwardly by the rotary impacting device in front of said screening means so as to abrade a top surface of the ground.

10. The apparatus according to claim 2, wherein the screening means has a guiding portion at bottom thereof such that a portion of rocks not comminuted upon impact are fed to the rotary impacting device.

11. The apparatus according to claim 10, wherein a gap is defined between a bottom of the guiding portion arid the ground, such that rocks below a predetermined size can exit the apparatus therethrough upon the frame being displaced.

12. The apparatus according to claim 9, wherein a position of the screening means is adjustable with respect to the frame to adjust a depth of abrasion of the top surface.

13. An apparatus for comminuting rocks, comprising:

a frame having a restrictive passageway with an inlet and an outlet end for relative displacement of rocks from the inlet to the outlet end;

a rotary impacting device secured to the frame in the passageway so as to be journaled with respect to the frame, the rotary impacting device having at least one hammer element on an outer periphery of the device, the at least one hammer element adapted to scoop and impact rocks in the passageway to project the rocks toward the outlet of the apparatus, actuation means mounted to the frame and operationally connected to the rotary impacting device for imparting a rotation of the rotary impacting device; and screening means adapted to comminute upon impact at least some of the rocks propelled thereon by the rotary impacting device, the screening means being positioned in the outlet end such that comminuted rocks exiting from the outlet end are below a predetermined size, a guiding portion at a bottom of the screening means such that a portion of rocks not comminuted upon impact are fed to the rotary impacting device.

14. The apparatus according to claim 13, the screening means has a plurality of vertically spaced apart ribs mounted to a support structure.

15. The apparatus according to claim 13, further comprising a protection screen at the inlet end to prevent rocks from being propelled out of the passageway by the rotary impacting device.

16. An apparatus for comminuting rocks, comprising:

a frame having a restrictive passageway with an inlet and an outlet end for relative displacement of rocks from the inlet to the outlet end;

a rotary impacting device secured to the frame in the passageway so as to be journaled with respect to the frame, the rotary impacting device having at least one hammer element on an outer periphery of the device, the at least one hammer element adapted to scoop and impact rocks in the passageway to project the rocks toward the outlet of the apparatus;

actuation means mounted to the frame and operationally connected to the rotary impacting device for imparting a rotation of the rotary impacting device; and screening means adapted to comminute upon impact at least some of the rocks propelled thereon by the rotary impacting device, the screening means being positioned in the outlet end such that comminuted rocks exiting from the outlet end are below a predetermined size, wherein a portion of the rocks are directed downwardly by the rotary impacting device in front of said screening means so as to abrade a top surface of the ground.

17. The apparatus according to claim 16, further comprising a protection screen at the inlet end to prevent rocks from being propelled out of the passageway by the rotary impacting device.

* * * * *